US009464419B2

(12) United States Patent
Blum

(10) Patent No.: US 9,464,419 B2
(45) Date of Patent: Oct. 11, 2016

(54) JET REGULATOR

(75) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 0 days.

(21) Appl. No.: 14/236,654

(22) PCT Filed: Jun. 23, 2012

(86) PCT No.: PCT/EP2012/002671

§ 371 (c)(1),
(2), (4) Date: Feb. 3, 2014

(87) PCT Pub. No.: WO2013/020616

PCT Pub. Date: Feb. 14, 2013

(65) Prior Publication Data

US 2014/0166783 A1 Jun. 19, 2014

(30) Foreign Application Priority Data

Aug. 5, 2011 (DE) ..... 20 2011 104 074

(51) Int. Cl.

| | |
|---|---|
| ***E03C 1/084*** | (2006.01) |
| ***B05B 1/02*** | (2006.01) |
| ***B05B 1/14*** | (2006.01) |
| ***B05B 1/22*** | (2006.01) |
| ***E03C 1/086*** | (2006.01) |

(52) U.S. Cl.

CPC ..... *E03C 1/086* (2013.01); *B05B 1/02* (2013.01); *B05B 1/14* (2013.01); *B05B 1/22* (2013.01); *E03C 1/084* (2013.01)

(58) Field of Classification Search

CPC ..... B05B 1/02; B05B 1/14; B05B 1/22; Y10T 137/9464; Y10S 239/23; E03C 1/08; E03C 1/084; E03C 1/086; E03C 2001/082

USPC ..... 239/428.5, 587.1, 587.5, 590, 590.3, 239/600, DIG. 4

See application file for complete search history.

(56) References Cited

U.S. PATENT DOCUMENTS

| | | | | |
|---|---|---|---|---|
| 2,053,807 | A | 9/1936 | Wadsworth | |
| 2,983,533 | A * | 5/1961 | Tisch | F16J 15/32 277/649 |
| 3,730,439 | A * | 5/1973 | Parkison | 239/590.3 |
| 4,119,276 | A * | 10/1978 | Nelson | E03C 1/086 239/590.3 |
| 4,470,546 | A * | 9/1984 | Wildfang | E03C 1/084 239/428.5 |
| 5,165,121 | A * | 11/1992 | McTargett et al. | 4/678 |

(Continued)

FOREIGN PATENT DOCUMENTS

| | | |
|---|---|---|
| WO | 03071171 | 8/2003 |

*Primary Examiner* — Arthur O Hall
*Assistant Examiner* — Christopher R Dandridge
(74) *Attorney, Agent, or Firm* — Volpe and Koenig, P.C.

(57) ABSTRACT

The invention relates to a jet regulator (1) with a sleeve-shaped jet regulator housing (2), which (2) can be mounted on the water outlet of a plumbing outlet armature, and with a sealing ring (5) made of elastic material, which (5) seals in an axial direction against an adjoining annular flange at the water outlet of the outlet fixture. On the front inner peripheral area (6) of the jet regulator housing (2) on the inflow side, there is provided at least one housing undercut (7), which secures, on the jet regulator housing (2), the sealing ring (5), inserted into the housing interior (8) of the jet controller housing (2). In the jet controller (1) according to the invention, the sealing ring (5) is effectively secured against unintended loss, for example, during transport or storage.

6 Claims, 1 Drawing Sheet

(56) References Cited

U.S. PATENT DOCUMENTS

| | | | | |
|---|---|---|---|---|
| 7,677,473 | B2 * | 3/2010 | Kao | E03C 1/084 239/428.5 |
| 8,006,922 | B2 * | 8/2011 | Katzer | 239/428.5 |
| 2002/0084353 | A1 * | 7/2002 | Griffin | E03C 1/084 239/428.5 |
| 2003/0164594 | A1 | 9/2003 | Whitlow et al. | |
| 2005/0184713 | A1 * | 8/2005 | Xu et al. | 323/282 |
| 2007/0205310 | A1 * | 9/2007 | Zhou | 239/587.1 |
| 2008/0012328 | A1 | 1/2008 | Stein et al. | |
| 2008/0054574 | A1 | 3/2008 | McGarvey | |
| 2008/0191057 | A1 * | 8/2008 | Stein | E03C 1/086 239/428.5 |
| 2009/0014963 | A1 | 1/2009 | Fietz | |
| 2011/0133415 | A1 | 6/2011 | Vu | |

* cited by examiner

JET REGULATOR

BACKGROUND

The invention relates to a jet regulator having a sleeve-shaped jet-regulator housing, which can be mounted on the water outlet of a sanitary outlet fitting, and having a sealing ring comprised of an elastic material, which has a rectangular cross section with approximately parallel longitudinal walls and which seals in the axial direction against an adjacent annular surface on the water outlet of the outlet fitting.

FR 2 948 133 A1 discloses a jet regulator having a sleeve-shaped jet-regulator housing, which can be mounted on the water outlet of a sanitary outlet fitting. A sealing ring is provided in order to be able to seal the jet-regulator housing in the axial direction against an adjacent annular face on the water outlet of the outlet fitting. The sealing ring, which has a rectangular cross section with approximately parallel longitudinal walls, is inserted into the jet-regulator housing on the inflow side in such a manner that the sealing ring, with the part-region facing toward the jet-regulator housing, fits closely in a frictionally engaged manner on the housing inner circumference of the jet-regulator housing, whereas that part-region of the sealing ring which faces away from the jet-regulator housing protrudes beyond the jet-regulator housing. There is, however, the risk of the sealing ring being unintentionally deformed, in such a manner that the sealing ring falls out of the jet-regulator housing and is lost, during shipping or mounting of the disclosed jet regulator. Since loss of the sealing ring also causes the remaining components of the disclosed jet regulator to lose their retention in the jet-regulator housing, there is the risk of the disclosed jet regulator coming apart and being almost impossible, in particular for the unacquainted user, to reassemble in a properly functioning manner.

NL 110 837 C discloses a screw connection intended for the assembly of two pipe sections. For this purpose, these two pipe sections have, on their mutually facing pipe ends, mutually corresponding threads, such that the first pipe end featuring an external thread can be screwed into the internal thread provided in the adjacent second pipe end. In order to secure this screw connection, a lock nut is screwed onto the external thread provided on the first pipe end. This lock nut has, on its end side facing toward the second pipe end, a depression which features an encircling undercut protruding radially toward the inside. A sealing ring, which on the outer circumference has an annular shoulder, is inserted into this depression. This annular shoulder is engaged from behind by the undercut in such a manner that the sealing ring is securely retained with slight axial play on the lock nut. Since the sealing ring in the disclosed screw connection has a complex contour, its manufacture requires a relatively high outlay. Due to its complex contour, the sealing ring is unable to provide a uniform sealing effect over its entire bearing face.

A jet regulator, which is to form a homogenous, non-spraying and sparkling soft water jet at the water outlet of a sanitary outlet fitting, is disclosed in EP 1 770 225 B1. The disclosed jet regulator has a sleeve-shaped jet-regulator housing, jet-forming functional elements being provided in its housing interior. A sleeve-shaped outlet mouthpiece, into which the jet-regulator housing can be inserted from the inflow side as far as an insertion stop, is assigned to the disclosed jet regulator. The outlet mouthpiece has an internal thread which interacts with an external thread on the water outlet of the outlet fitting. The jet regulator disclosed in EP 1 770 225 B1 is secured in the outlet mouthpiece with a sealing ring comprised of an elastic material, said sealing ring being intended for sealing in the axial direction between the inlet-side end-edge region of the jet-regulator housing and an adjacent annular face on the water outlet of the outlet fitting. In order to captively retain the sealing ring in the outlet mouthpiece, at least one retaining projection, which protrudes into the internal thread on the inner circumference of the outlet mouthpiece, is provided on the outer circumference of the sealing ring. The sealing ring designed with at least one retaining projection can, however, only be utilized in an advantageous manner together with an outlet mouthpiece.

However, jet regulators which feature an external thread on the outer circumference of their sleeve-shaped jet-regulator housing have already been created. These disclosed jet regulators can, with the external thread provided on their jet-regulator housing, be screwed into an internal thread on the water outlet in such a manner that such a jet regulator terminates in an approximately flush manner with the outflow-side end edge of the water outlet. These jet regulators, which feature an external thread, do not rely on an additional outlet mouthpiece. In the case of such jet regulators, the required sealing ring can only be added with the risk that the sealing ring could potentially be lost during storage and shipping.

SUMMARY

The object thus exists in particular to provide a jet regulator of the type mentioned at the outset which can be stored, shipped and even readily mounted in any type of installation situation not only in connection with an outlet mouthpiece, but also in an embodiment featuring an external thread, without having to worry about the unintentional loss of the required sealing ring.

This object is met according to this invention in that the jet regulator of the type mentioned at the outset is formed in particular with at least one housing undercut provided on the inner circumference on the inlet-side end-edge region of the jet-regulator housing, by means of which housing undercut the sealing ring, which is inserted into the housing interior of the jet-regulator housing, is secured on the jet-regulator housing, and in that the housing undercut is to this end formed into the elastic material of the sealing ring in such a manner that the sealing ring is retained in the housing interior so as to be immovable in the axial direction.

In the case of the jet regulator according to the invention, a housing undercut, which is formed into the elastic material of the sealing ring in such a manner that the sealing ring is retained in the housing interior so as to be immovable in the axial direction, is provided on the inner circumference on the inlet-side end-edge region of the jet-regulator housing. Since the housing undercut is formed into the elastic material of the sealing ring, an annular flange or an annular shoulder is not additionally required. The sealing ring used according to the invention much rather can have a rectangular cross section with approximately parallel longitudinal walls, making it unnecessary to pay attention to the installed position of the sealing ring. This design of the jet regulator according to the invention facilitates its mechanized and accordingly cost-effective assembly. Since the sealing ring is always securely retained on the jet-regulator housing in this manner, unintentional loosening and loss of the sealing ring is not of concern even when the jet regulator according to the invention is configured such that it does not require an additional outlet mouthpiece.

In order for the sealing ring to be securely and tightly retained on the housing undercut provided on the inlet-side end-edge region of the jet-regulator housing, it is expedient for the sealing ring to have, at the outflow side on its ring outer circumference, an annular flange or annular shoulder which engages behind the housing undercut.

The jet regulator according to the invention also requires jet-forming functional elements in order to form a homogenous, non-spraying and, if applicable, sparkling soft water jet. These jet-forming functional elements are preferably manufactured as insert parts which can be inserted into the housing interior of the jet-regulator housing. In order that the functional elements which are inserted into the housing interior of the jet-regulator housing can now be securely retained in the jet-regulator housing, provision is made for the at least one insert part, which can be inserted into the housing interior as far as an insertion stop, to be secured in the housing interior by means of the sealing ring.

In one embodiment which is particularly simple to engineer and easy to manufacture, the at least one insert part is retained in the housing interior between the insertion stop, which is assigned to said insert part, and the sealing ring.

In order to be able to properly and uniformly form the water flowing through the jet regulator according to the invention, it is expedient that the at least one insert part has a perforated structure, grate structure, or mesh structure.

One embodiment according to the invention may provide that the jet regulator according to the invention, the sealing ring of which is secured on a housing undercut of its jet-regulator housing, is inserted into an outlet mouthpiece featuring a thread which can be mounted on a mating thread on the water outlet of the sanitary outlet fitting. In contrast, a preferred refinement according to the invention however provides that the jet-regulator housing features, on its housing outer circumference, an external thread for screwing into an internal thread provided in the water outlet of the outlet fitting. Even in the case of such a refined embodiment, which does not require an additional outlet mouthpiece, the sealing ring required for axial sealing is reliably and tightly secured on the jet-regulator housing.

BRIEF DESCRIPTION OF THE DRAWINGS

Refinements according to the invention will emerge from the description together with the drawings. In the following, the invention is described in more detail by means of preferred exemplary embodiments.

In the drawings.

DETAILED DESCRIPTION OF THE EMBODIMENTS

Figure 2:
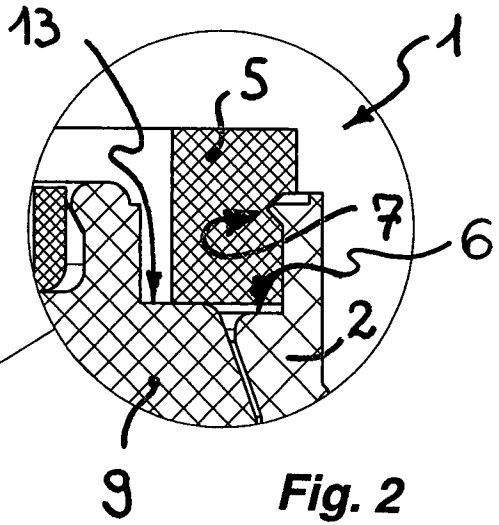
FIG. 2 shows a detailed view of the longitudinal section of the jet regulator from FIG. 1 in the region of the housing undercut, formed into the sealing ring, of the jet-regulator housing.
Figure 1:
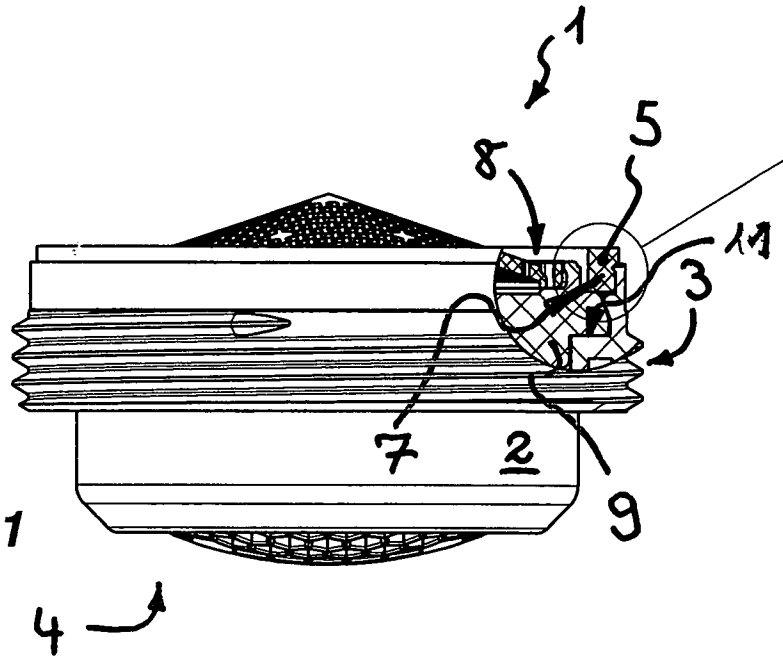
FIG. 1 shows a jet regulator which, on the inlet-side end-edge region of its sleeve-shaped jet-regulator housing, has a housing undercut on the inner circumference, wherein a sealing ring is provided for axial sealing between the between the inlet-side end-edge region of the jet-regulator housing and an adjacent annular face on the water outlet of a sanitary outlet fitting, the housing undercut being formed into the elastic material of said sealing ring.

A jet regulator is shown in FIGS. 1 and 2. The jet-regulator embodiment 1 illustrated here has a sleeve-shaped jet-regulator housing 2, which can be mounted on the water outlet of a sanitary outlet fitting (not shown in more detail here) in order to form there a homogenous, non-spraying and, if applicable, also sparkling soft water jet. In order to be able to mount the jet-regulator housing 2 on the water outlet of the sanitary outlet fitting, a sleeve-shaped outlet mouthpiece, into which the jet-regulator housing can be inserted from the inflow side as far as an insertion stop, may be provided, wherein the outlet mouthpiece features an external or internal thread which interacts with a mating thread on the water outlet.

What is preferred, however, is the jet-regulator embodiment 1 illustrated here, in which the jet-regulator housing 2 has on its housing outer circumference an external thread 3 which can be screwed into an internal thread provided in the water outlet of the sanitary outlet fitting, preferably in such a manner that the outlet end side 4 of the jet-regulator housing 2 terminates in an approximately flush manner with the outlet-side end edge of the water outlet.

The jet-regulator embodiment 1 has a sealing ring 5 comprised of an elastic material which seals in the axial direction against an adjacent annular face on the water outlet of the outlet fitting. At least one housing undercut 7, by means of which the sealing ring 5 inserted into the housing interior 8 of the jet-regulator housing 2 and preferably protruding beyond the inflow side of the jet-regulator housing 2 is secured in its position on the jet-regulator housing 2, is provided here on the inner circumference on the inlet-side end-edge region 6 of the jet-regulator housing.

Since the sealing ring 5 is securely retained on the jet-regulator housing 2, unintentional loss of the sealing ring 5 is avoided.

It is clear from FIGS. 1 and 2 that at least one insert part 9, which may have a perforated structure, grate structure, or mesh structure, can be inserted from the inflow side of the jet-regulator housing 2 into the housing interior 8. If the at least one insert part 9 has a grate structure or a mesh structure, said structure is formed by groups of webs that mutually intersect at intersection points. It can be seen in FIGS. 1 and 2 that the sealing ring 5, which is securely retained on the jet-regulator housing 2, also secures the at least one insert part 9 in the housing interior 8 of the jet-regulator housing 2. Here, the at least one insert part 9 is retained between an insertion stop 11, which is assigned to the former, and the sealing ring 5. The sealing ring 5 of the jet-regulator embodiment 1 seals in the axial direction between the inlet-side end-edge region 6 of the jet-regulator housing 2 and/or the inflow-side end face 13 of the insert part 9, one the one hand, and an adjacent annular face on the water outlet of the outlet fitting, on the other hand.

The sealing ring 5 in the jet-regulator embodiment 1 illustrated in FIGS. 1 and 2 has a rectangular cross section with approximately parallel longitudinal walls. It can be seen clearly here in the partial view of the longitudinal section in FIG. 2 that the housing undercut 7 is formed into the elastic material of the sealing ring 5 in such a manner that said sealing ring 5 is securely retained in the housing interior 8 so as to be immovable in the axial direction and can only be released from its secured position in the jet-regulator housing 2 by, for example, manual deformation of the sealing ring 5.

LIST OF REFERENCE SIGNS

Jet-regulator embodiment (according to FIGS. 1 and 2) 1
Jet-regulator housing 2
External thread (on the jet-regulator housing) 3
Outlet end side (of the jet-regulator housing 2) 4

Sealing ring 5
Inlet-side end-edge region (of the jet-regulator housing 2) 6
Housing undercut 7
Housing interior 8
Insert part 9

The invention claimed is:

1. A jet regulator (1) comprising a sleeve-shaped jet-regulator housing (2), with external threads for attachment of the jet regulator (1) to a water outlet of a sanitary outlet fitting, and having a sealing ring (5) comprised of an elastic material, which has a rectangular cross section with approximately parallel longitudinal walls and which seals in an axial direction against an adjacent annular surface on the water outlet of the outlet fitting, at least one housing undercut (7) is provided on an inner circumference on an inlet-side end-edge region (6) of the jet-regulator housing (2), by which the sealing ring (5), which is inserted into a housing interior (8) of the jet-regulator housing (2), is secured on the jet-regulator housing (2), and the housing undercut (7) is formed into the elastic material of the sealing ring (5) in such a manner that the sealing ring (5) is retained in the housing interior (8) immovable in the axial direction.

2. The jet regulator as claimed in claim 1, wherein the sealing ring (5), which is inserted into the jet regulator housing (2), protrudes beyond an inflow side of the jet-regulator housing (2).

3. The jet regulator as claimed in claim 1, wherein proceeding from an inflow side of the jet regulator housing (2), at least one insert part (9) is insertable into the housing interior (8) as far as an insertion stop (11), and the at least one insert part (9) is secured in the housing interior (8) by the sealing ring (5).

4. The jet regulator as claimed in claim 3, wherein the at least one insert part (9) is retained in the housing interior (8) between the insertion stop (11) and the sealing ring (5).

5. The jet regulator as claimed in claim 3, wherein the at least one insert part (9) has a perforated structure, grate structure, or mesh structure.

6. The jet regulator as claimed in claim 1, wherein the jet-regulator housing (2) includes, on a housing outer circumference thereof, an external thread (3) for screwing into an internal thread provided in the water outlet of the outlet fitting.

* * * * *